US010352126B2

(12) United States Patent
Budler

(10) Patent No.: US 10,352,126 B2
(45) Date of Patent: Jul. 16, 2019

(54) ACTIVATION DEVICE AND ACTIVATION OF MULTIPLE DOWNHOLE TOOLS WITH A SINGLE ACTIVATION DEVICE

(71) Applicant: Halliburton Energy Services, Inc., Houston, TX (US)

(72) Inventor: Nicholas Frederick Budler, Marlow, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/544,512

(22) PCT Filed: Feb. 19, 2015

(86) PCT No.: PCT/US2015/016709
§ 371 (c)(1),
(2) Date: Jul. 18, 2017

(87) PCT Pub. No.: WO2016/133524
PCT Pub. Date: Aug. 25, 2016

(65) Prior Publication Data
US 2017/0370178 A1 Dec. 28, 2017

(51) Int. Cl.
*E21B 33/13* (2006.01)
*E21B 34/14* (2006.01)
*E21B 47/12* (2012.01)

(52) U.S. Cl.
CPC ..... *E21B 33/13* (2013.01); *E21B 34/14* (2013.01); *E21B 47/12* (2013.01)

(58) Field of Classification Search
CPC ..... E21B 33/13; E21B 34/14; E21B 47/12
See application file for complete search history.

(56) References Cited

U.S. PATENT DOCUMENTS

| | | | | |
|---|---|---|---|---|
| 4,580,761 | A * | 4/1986 | Silcox | E21B 34/04 251/129.11 |
| 8,678,098 | B2 | 3/2014 | Soni et al. | |
| 2008/0053651 | A1* | 3/2008 | Hern | E21B 27/005 166/173 |
| 2009/0016950 | A1* | 1/2009 | Little | C01B 32/25 423/446 |
| 2011/0240311 | A1* | 10/2011 | Robison | E21B 23/04 166/373 |
| 2013/0020092 | A1 | 1/2013 | Ramon et al. | |
| 2013/0048290 | A1 | 2/2013 | Howell et al. | |
| 2015/0027724 | A1 | 1/2015 | Symms et al. | |
| 2015/0041146 | A1 | 2/2015 | Fripp et al. | |
| 2016/0084075 | A1* | 3/2016 | Ingraham | E21B 23/10 166/255.1 |

OTHER PUBLICATIONS

International Search Report and Written Opinion dated Oct. 30, 2015 for PCT Application PCT/US2015/016709 filed Feb. 19, 2015. 16 pages.

* cited by examiner

*Primary Examiner* — Giovanna C Wright
*Assistant Examiner* — Yanick A Akaragwe
(74) *Attorney, Agent, or Firm* — Chamberlain Hrdlicka

(57) ABSTRACT

An activation device is disclosed that can activate multiple downhole tools in a wellbore. The activation device is cost effective and easy to produce. A method for activating multiple downhole tools in a wellbore is described where at least one downhole tool is activated by magnetic field, while at least one additional downhole tool is activated by mating of the activation device with the downhole tool.

24 Claims, 3 Drawing Sheets

ACTIVATION DEVICE AND ACTIVATION OF MULTIPLE DOWNHOLE TOOLS WITH A SINGLE ACTIVATION DEVICE

In the performance of one or more wellbore operations (e.g., a drilling operation, a completion operation, a fluid-loss control operation, a cementing operation, production, or combinations thereof), it may be necessary to selectively manipulate one or more downhole tools which will be utilized in such operations. For example, when wellbores are prepared for oil and gas production, it is common to cement a casing string within the wellbore. Often, it may be desirable to cement the casing string within the wellbore in multiple, separate stages.

The casing string may be run into the wellbore to a predetermined depth. Various zones in the subterranean formation may be isolated via the operation of one or more packers, which may also help to secure the casing string in place during cementing. During the cementing operation, numerous downhole tools are used to create, control and monitor the cement structure.

Likewise, in the oil and gas industry, subterranean formations penetrated by a wellbore are often fractured or otherwise stimulated in order to enhance hydrocarbon production. Fracturing and stimulation operations are typically carried out by strategically isolating various zones of interest (or intervals within a zone of interest) in the wellbore using packers and the like, and then subjecting the isolated zones to a variety of treatment fluids at increased pressures. In a typical fracturing operation for a cased wellbore, the casing cemented within the wellbore is first perforated to allow hydrocarbons within the surrounding subterranean formation to flow into the wellbore. Prior to producing the hydrocarbons, however, treatment fluids are pumped into the wellbore and through the perforations into the formation, which has the effect of opening and/or enlarging drainage channels in the formation, and thereby enhancing the producing ability of the well.

It is possible to stimulate multiple zones during a single stimulation operation by using onsite stimulation fluid pumping equipment. In such applications, several packers are introduced into the wellbore and each packer is strategically located at predetermined intervals configured to isolate adjacent zones of interest. Once the packers are appropriately deployed, a wellbore activation device may be introduced into the wellbore to selectively engage a corresponding downhole tool in order to perform a predetermined action thereon. For example, the activation device may engage and shift a sleeve to open ports that allow fluid communication into an isolated zone for treatment or stimulation. Heretofore, once the isolated zone had been properly stimulated, a subsequent activation device would have to be dropped to interact with another downhole tool, uphole of the previous downhole tool, for stimulation thereabove.

Activation devices are typically sent into the wellbore strategically, in a predetermined fashion depending, for example, on their relative size. For instance, the smallest activation devices are introduced into the wellbore prior to the larger activation devices, where the smallest activation device is suitable for interacting with the downhole tool furthest in the well, and the largest activation device is suitable for interacting with the downhole tool closest to the surface of the well. If the wrong size activation tool is introduced into the wellbore, remedial operations to remove the device can be costly and time-consuming. Further, current methods utilize unique activation devices, e.g., plug, dart, ball, etc., for each individual tool as the activation of the downhole tool is often physical, e.g., the activation device is caused to land and to seat appropriately to activate the tool.

As an alternative to activation devices that physically engage the downhole tool, other generator/sensor combinations have been suggested including using near field communication signals. Such signals include electromagnetic communication as well as modulated digital signals. The downside is that many of these devices require power or battery sources which can have an adverse effect when left in the wellbore.

Accordingly, those skilled in the art will readily appreciate the need for an activation device that can activate multiple downhole tools, which activation device is cost effective and easy to produce. Such an activation device and method could eliminate many of the issues and overcome the limitations of the prior art activation devices and methods.

DESCRIPTION

Figure 1:
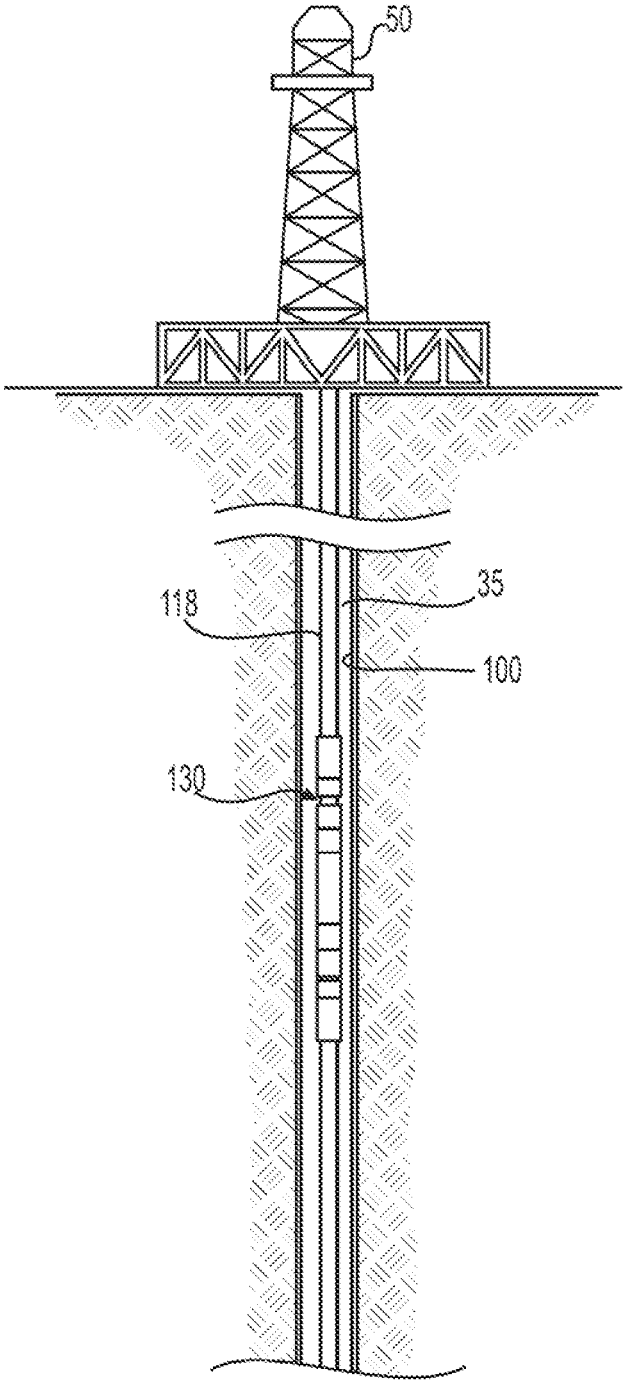
FIG. 1 illustrates one embodiment of an oil well rig and a wellbore including a downhole tool.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different form. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "up-hole," or other like terms shall be construed as generally from the formation toward the surface or toward the surface of a body of water; likewise, use of "down," "lower," "downward," "down-hole," or other like terms shall be construed as generally into the formation away from the surface or away from the surface of a body of water, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

As used herein "activation device" and "activating device" are interchangeable and refer to the structure that is sent into the wellbore to activate a downhole tool.

Embodiments relate generally to well systems and activating devices, as well as methods for using such activating devices, for controlling downhole tools in a wellbore. In at least one embodiment the activating device may be used to control (for example, actuate or modify the position/function of) a downhole tool (e.g. a flow control device) in a wellbore during drilling, completion, or production of the well. For example, there may be a need to bypass the flow controls to stimulate the formation (production zone) or remove filter cake. There may also be a need to isolate production zones or individual flow control devices (for maintenance purposes, for example) and/or conduct multiple (and possibly different) operations on separate zones of the wellbore during the production life of a well. Therefore, devices and methods allowing multiple downhole tools to be exercised or operated by a single activation device, provide for more flexible control of downhole tools in a wellbore and, therefore, more control of overall production. More specifically, devices and methods as described operate or activate at least one downhole tool by subjecting that tool to a magnetic field and operate or activate at least one additional downhole tool by physical engagement between the activation device and the downhole tool.

While the disclosure generally describes the activation of one tool electromagnetically and another tool physically, the activation of multiple operations on a single tool is contemplated. For example, an inflation packer could have both an electromagnetic trigger and the physical engagement of the activation device to open up the tool to well pressure. Likewise, the disclosure contemplates the use of the magnetic field on an activation device to trigger more than a single downhole tool.

According to at least one embodiment, the activation device as described comprises a physical characteristic that physically engages with a specific downhole tool and activates a specific operation of that tool. The activation device also comprises a magnetic field generator that generates a magnetic field to activate an operation on the same or a different tool when passed close to the tool. As used herein the term "physical engagement" refers to the relationship between the downhole tool and its counterpart activation device. Engaging can include any mechanism by which the activation device comes into proximity or contact with the downhole tool and causes the downhole tool to activate. Engaging can include for example, physically engaging, or marrying, as well as proximity sensors or other features used on the downhole tool to establish activation. According to one embodiment, an external configuration on the activation device couples to an internal configuration on the downhole tool. According to another embodiment, an internal configuration on the activation device couples to an external configuration on the downhole tool.

In at least one embodiment, the activation device is configured so that it operatively engages only the desired downhole tool, out of multiple items of equipment installed in the casing string, by configuring or equipping the activation device with a particular shape designed to engage only a particular profile formed in the desired downhole tool. According to at least one embodiment, the activation device includes a shape that is formed in the activation device. According to another embodiment, it is the shape of the activation device itself that engages with its mirror image in the downhole tool. For example, the configuration could be as a dart, a ball or a plug. For cementing processes, as the activation device may include a plug, for example, a floppy cup wiper plug, a free fall plug, a five wiper plug, a high wiping efficiency (HWE) plug, and the downhole tool could be equipped or configured to receive the shape of the activation device.

The activation device (regardless of the shape chosen) can be equipped with a generator for creating a magnetic field that can be recognized by a desired downhole tool. The magnetic field may be generated by any suitable method. For example, the magnetic field may be generated electromagnetically or from permanent magnets. While the emitted field can be generated by any electrically driven assembly, the use of magnets which require no power source can have design advantages. Likewise, the magnetic field may be carried by a magnetic strip. According to one embodiment, suitable known activation devices can be retrofit to include the magnetic field generator.

In at least one embodiment, the magnetic field may be generated by a permanent magnet. A magnetic field generated by a permanent magnet has the benefit or needing no power source. As no power source is necessary, the activation devices described herein that use a permanent magnetic to generate magnetic field, can be used in harsher environments. The magnetic field may be a simple magnetic field or can be complex. For example, the magnetic field can be generated by a simple pair or magnets or multiple fields can be generated depending upon the number and placement of the magnets.

In another embodiment, the magnetic field may be generated electromagnetically. Any suitable method for electromagnetic generation of the magnetic field can be used. According to one embodiment the magnetic field is generated by a Tesla coil. The activation device may have more than a single magnetic field that is recognized by individual downhole tools. Appropriate fields and the manner of generating them will be readily apparent to the skilled artisan. According to one embodiment, a series of downhole tools may be systematically activated by one magnetic field. According to another embodiment, a series of downhole tools may be activated by multiple magnetic fields.

FIG. 1 illustrates one embodiment of a well 100 with a rig 50. The embodiment in FIG. 1 depicts a wellbore 100 having a casing string 118 and a packer 130 surrounding the casing string 118. The packer 130 is a downhole tool that may be activated using the methods and activating devices as described herein. According to this embodiment, for example, the packer 130 may have a swell packer which, will swell in the presence of hydraulic fluid. The activating device as described may be sent into the wellbore to provide a magnetic field in proximity of the packer 130. The magnetic field may trigger a valve to open thereby exposing the packing element to the swelling fluid. After activating and manipulating the downhole tool in the desired manner, the activating device may proceed further into the wellbore where it can contact another downhole tool and activate operations therewith.

Figure 2:
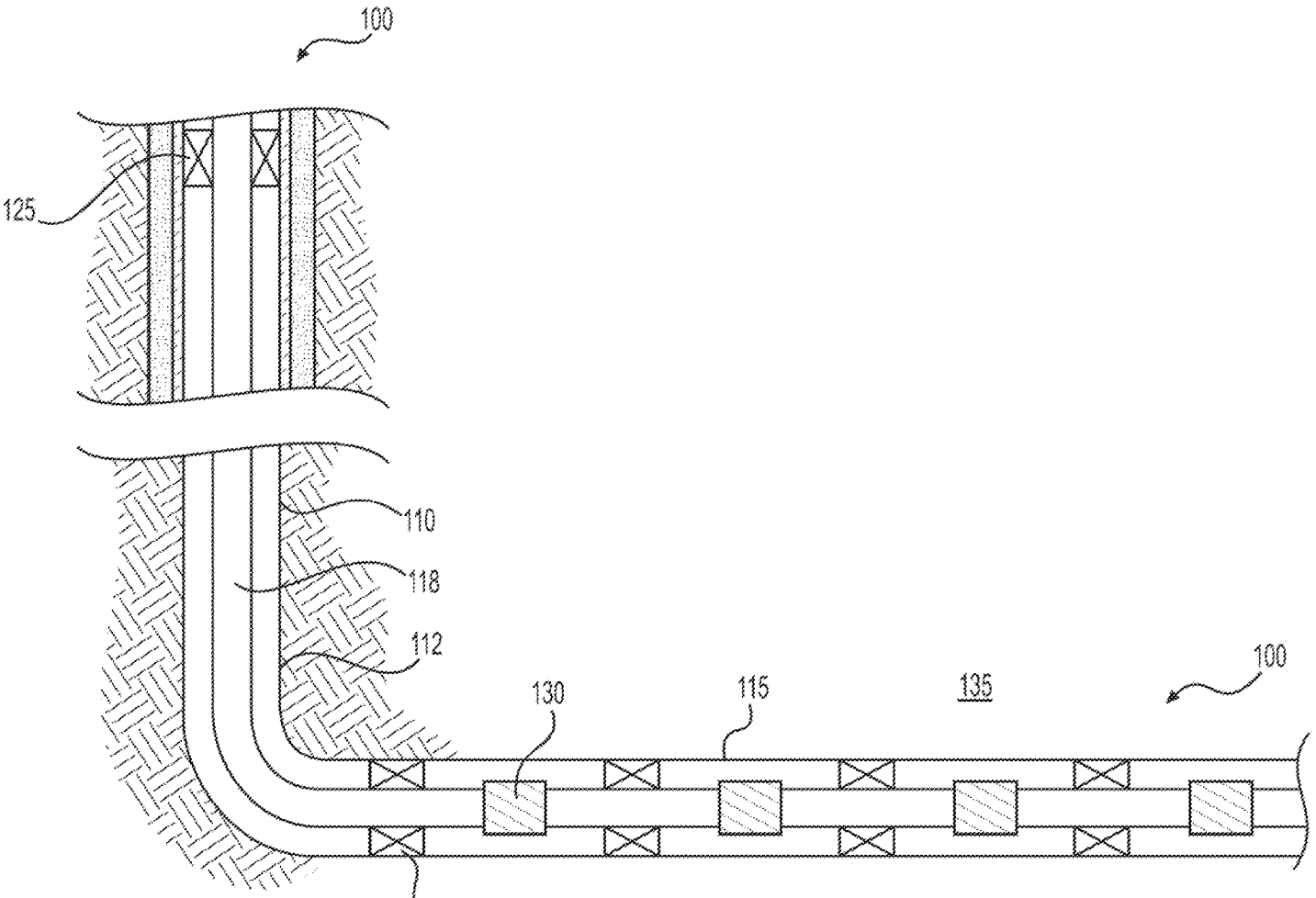
FIG. 2 is a close up schematic illustration of a portion of the well system of FIG. 1 including a plurality of downhole tools according to at least one embodiment.

Referring to FIG. 2, an exemplary well system is depicted, comprising a wellbore 100 with both a substantially vertical section 110 and a substantially horizontal section 115, a casing string 118, a plurality of spaced apart packers 125 and downhole tools 130 (which may include flow control devices, for example) and a formation 135. In the example shown in FIG. 1, production of hydrocarbons may be accomplished by flowing fluid containing hydrocarbons from the formation 135, though the uncased and open horizontal wellbore section 115 and into the casing string 118 through the plurality of downhole tools 130. In other embodiments, production might include flowing hydrocarbon containing fluid from the formation through perforations in the casing and into the casing string 118 through downhole tool(s) 130. As an example, downhole tools 130 might comprise an inflow control device (ICD) that provides for the filtering of unwanted material from the formation 135 and/or for the metering of fluid input from the formation 135 into the casing string 118. Packers 125 isolate each individual downhole tool 130 into different zones or intervals along the wellbore 100 by providing a seal between the casing/wellbore wall 112 and the casing string 118.

Although FIG. 2 depicts the downhole tools 130 in an open and uncased horizontal wellbore section 115, it is to be understood that downhole tools may also be used in cased wellbores. Further, although FIG. 2 depicts single downhole tools 130 as being isolated by the packers 125, it is to be understood that any number of downhole tools may be grouped together and isolated by the packers, without departing from the principles of the present disclosure. In addition, even though FIG. 2 depicts the downhole tools 130 in a horizontal wellbore section 115, it is also to be understood that the downhole tools 130 are equally suited for use in wellbores having other directional configurations including vertical wellbores, deviated wellbores, slanted wellbores, multilateral wellbores and the like. The downhole tools illustrated are exemplary. Although much of the discussion herein is focused on operation of ICDs through a downhole ICD controller installed in a production well, that is, operation of valves to shut-off, open or bypass ICDs, the invention can be used to operate many downhole tools. For example, the inventions can be used to operate sliding sleeves, valves, annular isolation devices, rupture discs, sand face monitoring tools, fluid analysis devices, actuators, electric motors, charges, etc.

The downhole tools 130 may include a variety of tools, devices, or machines known to those skilled in the art that may be used in the preparation, e.g., cementing, stimulation, and production of the subterranean formation 135. In at least one embodiment, one or more of the downhole tools 130 may be a fluid collection device, such as a fluid sampler, or a fluid restriction device, such as a valve, inflow control device, autonomous inflow control device, adjustable inflow control device, or the like. In yet other embodiments, one or more of the downhole tools 130 may include packers and other wellbore isolation devices, drilling tools, and devices configured to initiate and/or stop data acquisition/transmission. In yet further embodiments, one or more of the downhole tools 130 may encompass two or more of the above-identified devices, without departing from the scope of the disclosure.

Figure 3:
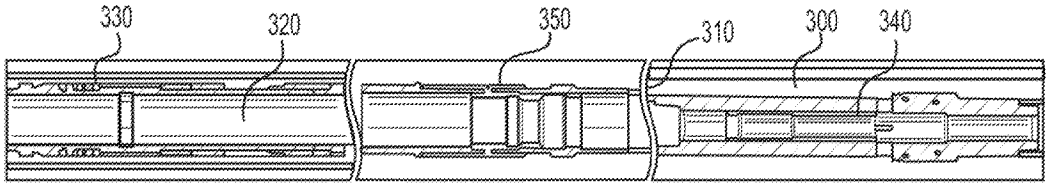
FIG. 3 illustrates one embodiment of a casing string with a downhole tool.
Figure 4:
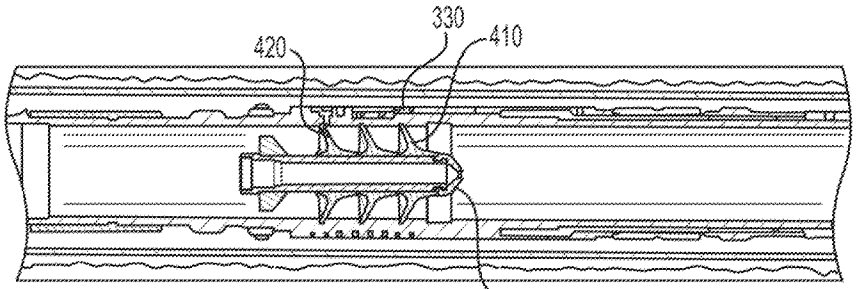
FIG. 4 is an enlarged view of FIG. 3 including an activation device engaged with a downhole tool according to at least one embodiment.
Figure 5:
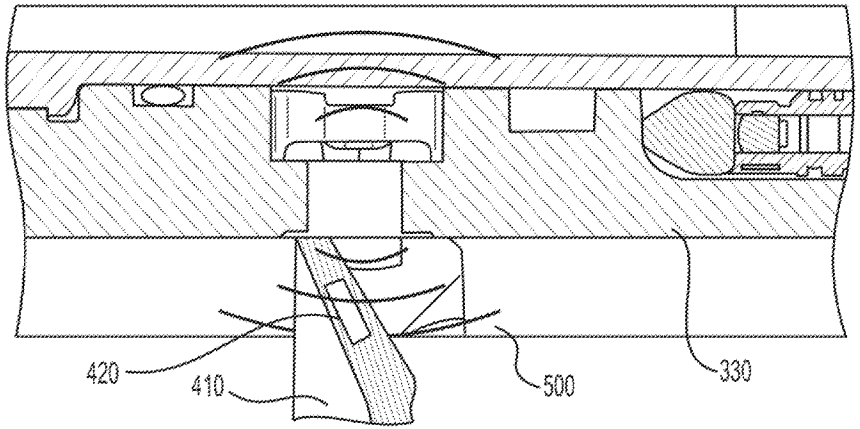
FIG. 5 is an enlarged view of FIG. 4. and illustrates activation of a downhole tool by a magnetic element carried by the activation device.

FIGS. 3-5 illustrate one embodiment of a multiple downhole tool activation using a single activation device 410. FIG. 3 is a cutaway of a wellbore 100. The casing string 320 includes downhole tools 330, 350 and 340. Tools 330 and 350 surround the casing string 320 in the annular space between the wellbore 100 and the casing string 320. Downhole tool 340 is in area 300 inside the casing string 320. Casing joints are shown at 310.

FIG. 4 shows a cutaway view of the casing string 320. According to the embodiment shown, the activation device 410, a dart, resides inside the casing string 320. As the activation device 410 passes downhole tool 330, the tool is activated by a magnetic field 500 that emanates from the magnet 420 that is found in the wiper extension on the tool 410 as seen in FIG. 5. The activation device 410 then proceeds along the casing string 320 to activate additional tools 350 and 340. Downhole tool 340 may be activated by contact with, for example, the nose 400 of the dart 410, or alternatively by the tail stock.

According to at least one embodiment where the activation device is used in a cementing operation, the activation device may be used with one or more tools including for example, a bridge plug, a permanent or retrievable tension packer, a retrievable or permanent compression packer, a a retrievable hydraulic-set packer, a single string packer, a dual string packer, PRESIDIUM EC@ Packer, A BAKER ZX-E PACKER, a multiple stage cementer (ESII, ES, etc.), cementer-packer collars (ESIPC II, MSIPC, MSPCC, etc.), a diverter (340 in FIG. 3), float Equipment, or signal surface equipment, for example, Commander 1000.

The method described in the instant disclosure is a method for activating multiple downhole tools along the same casing string or in the same wellbore, using a single activation device that is sent down the wellbore. Typically the activation device will be pumped down or dropped down the wellbore.

The activation device can activate a downhole tool by subjecting the tool to the magnetic field as the activating device passes the downhole tool. The downhole tools are configured to recognize the magnetic field by the inclusion of sensors in the downhole tools. Sensors for use in the downhole tools may be any suitable sensors that can detect and respond to the magnetic field. Suitable sensors according to one embodiment are described in U.S. Pat. Nos. 8,616,276 and 8,646,537.

According to at least one embodiment, the activation device possesses more than one magnetic field and different downhole tools are configured to recognize different magnetic fields. According to this embodiment, the activation device is sent into the wellbore and passes a first downhole tool that activates in the presence of the magnetic field. The activation device continues down the well bore until it encounters another downhole tool, which like the previous downhole tool, activates in the presence of a magnetic field. According to this embodiment, the activation device can continue down the wellbore activating other devices as appropriate. And in at least some embodiments, the activation device will be mated with a final downhole tool that will be activated by the presence of the activation device.

According to one embodiment, a downhole tool may be activated by a first magnetic field on a first activation device and then deactivated by a magnetic field on a second activation device.

According to one embodiment, the activation device may be a floppy cup wiper plug, a free fall plug, a five wiper plug, a high wiping efficiency (HWE) plug. For example, the activation device may be a free falling plug that has permanent magnets embedded into the plug material. Alternatively, the activation device may be a free falling plug that has magnets adhered to its plug housing. The activation device may be a five wiper plug that has magnets located between the cups and away from the cup edges.

According to one embodiment, the activating device is a wiper cup that has had permanent magnets impregnated into the cup portion of the wiper cup. Alternatively the activation device may be configured as a dart that is also impregnated with permanent magnets. As used herein, impregnated with permanent magnets refers to the inclusion of permanent magnets into the construction of the activation device, while adhered to the activation device refers to any method for coupling of the magnets to the device including but not limited to soldering, plating, potting, etc.

According to at least one embodiment, the activating device is a plug that includes a Tesla coil. In this embodiment, the plug may be any configuration as described above. Likewise, a Tesla coil may be used to generate the magnetic field for an activation device that is a dart or a ball.

Although the invention has been described in detail in the foregoing embodiments for the purpose of illustration, it is to be understood that such detail is solely for that purpose and that variations can be made therein by those skilled in the art without departing from the spirit and scope of the invention. Other embodiments of the present invention can include alternative variations. These and other variations and modifications will become apparent to those skilled in the art once the above disclosure is fully appreciated. It is intended that the following claims be interpreted to embrace all such variations and modifications.

What is claimed is:

1. A well system including a wellbore, comprising:

a non-expandable activation device comprising a magnetic field generator configured to generate a magnetic field;

a first downhole tool located in the wellbore and configured to be activated by the magnetic field; and a second downhole tool located in the wellbore comprising a profile formed in the second downhole tool and shaped to receive a shape of the activation device, the second downhole tool configured to be activated by physical engagement of the activation device with the second downhole tool, the second downhole tool separate and downhole from the first downhole tool, wherein the activation device is shaped to only physically engage with the profile formed in the second downhole tool.

2. The system of claim 1, wherein the magnetic field is generated by one or more permanent magnets.

3. The system of claim 2, wherein the activation device is a wiper cup and the magnetic field is generated by magnets impregnated into the wiper cup.

4. The system of claim 1, wherein the magnetic field is transmitted from a magnetic strip.

5. The system of claim 1, wherein the magnetic field is generated electromagnetically.

6. The system of claim 5, wherein the magnetic field is generated by a Tesla coil.

7. The system of claim 6, wherein the activation device is chosen from at least one of a floppy cup wiper plug, a dart, an HWE plug, a five wiper plug, a free fall plug, a composite ball.

8. The system of claim 1, wherein the activation device is chosen from at least one a dart, a plug, and a ball.

9. The system of claim 1, wherein the activation device is a plug and the magnetic field is generated by a Tesla coil.

10. The system of claim 1, wherein the second downhole tool comprises an inner profile; and the activation device comprises an outer profile for engaging the downhole tool's inner profile.

11. A method for activating at least two downhole tools in a wellbore using a single activation device comprising:

sending a non-expandable activation device into a wellbore, the activation device configured to generate a magnetic field;

activating a first downhole tool by proximity to the magnetic field from the activation device; and activating a second downhole tool comprising a profile formed in the second downhole tool and shaped to receive a shape of the activation device by physically engaging the second downhole tool with the activation device, the second downhole tool being separate and downhole from the first downhole tool, wherein the activation device is shaped to only physically engage with the profile formed in the second downhole tool.

12. The method of claim 11, wherein the first downhole tool comprises sensors for recognizing the magnetic field of the activating device.

13. The method of claim 12, wherein the activation device activates at least one additional downhole tool by contact with a magnetic field before physically engaging with the second downhole tool.

14. The method of claim 13, wherein the magnetic field is generated by a Tesla coil.

15. The method of claim 14, wherein the activation device is chosen from at least one of a floppy cup wiper plug, a dart, an HWE plug, a five wiper plug, a free fall plug, and a composite ball.

16. The method of claim 11, wherein the magnetic field is generated by one or more permanent magnets.

17. The method of claim 11, wherein the magnetic field is generated electromagnetically.

18. The method of claim 11, wherein the activation device is chosen from at least one a dart, a plug or a ball.

19. The method of claim 11, wherein the activation device is a plug and the magnetic field is generated by a Tesla coil.

20. The method of claim 11, wherein the activation device is a wiper cup and the magnetic field is generated by magnets impregnated into the wiper cup.

21. The method of claim 11, wherein the downhole tools are used in a cementing operation.

22. The method of claim 11, wherein the downhole tool are used in a production operation.

23. The method of claim 11, wherein the downhole tools are used in a completion operation.

24. The method of claim 11, wherein the downhole tools are used in a drilling operation.

* * * * *